US008093984B2

(12) United States Patent
Hofmann et al.

(10) Patent No.: US 8,093,984 B2
(45) Date of Patent: Jan. 10, 2012

(54) INSTALLATION SWITCHGEAR

(75) Inventors: Manfred Hofmann, Eberbach (DE); Wolfgang Pump, Ehrenfriedersdorf (DE); Ralf Wieland, Waldbrunn (DE); Albert Stieger, Plankstadt (DE); Joachim Majewski, Dossenheim (DE); Roland Ritz, Dielheim (DE); Klaus-Peter Eppe, Waldbrunn (DE); Erwin Muders, Heidelberg (DE); Joachim Becker, Schwetzingen (DE); Rainer Ludovici, Eppelheim (DE); Heinz-Erich Popa, Bammental (DE); Wolfgang Suess, Koenigswalde (DE)

(73) Assignee: ABB AG, Mannheim (DE)

( * ) Notice: Subject to any disclaimer, the term of this patent is extended or adjusted under 35 U.S.C. 154(b) by 260 days.

(21) Appl. No.: 12/597,964

(22) PCT Filed: Apr. 24, 2008

(86) PCT No.: PCT/EP2008/003275

§ 371 (c)(1),
(2), (4) Date: Oct. 28, 2009

(87) PCT Pub. No.: WO2008/131900

PCT Pub. Date: Nov. 6, 2008

(65) Prior Publication Data

US 2010/0127816 A1 May 27, 2010

(30) Foreign Application Priority Data

Apr. 28, 2007 (DE) ..... 10 2007 020 114
Apr. 3, 2008 (DE) ..... 10 2008 017 472

(51) Int. Cl.
*H01H 71/16* (2006.01)
*H01H 9/30* (2006.01)

(52) U.S. Cl. ..... 337/78; 337/3; 337/6; 337/7; 337/13; 337/36; 337/37; 337/70; 337/71; 337/75; 337/110; 337/112; 337/113; 335/8; 335/10; 335/141; 335/145; 335/201; 335/202; 218/151

(58) Field of Classification Search ..... 337/3, 6, 337/7, 13, 36, 37, 70, 71, 75, 78, 112, 113, 337/110; 335/141, 145, 8, 10, 201, 202; 218/151

See application file for complete search history.

(56) References Cited

U.S. PATENT DOCUMENTS 3,012,118 A * 12/1961 Edmunds ..... 335/6

(Continued)

FOREIGN PATENT DOCUMENTS

DE 4118377 A1 12/1992

(Continued)

*Primary Examiner* — Anatoly Vortman
(74) *Attorney, Agent, or Firm* — Leydig, Voit & Mayer, Ltd.

(57) ABSTRACT

An installation switching device includes a housing, a main contact point having an arc quenching chamber, an input terminal, an output terminal, an impact-style armature system configured to move the main contact point to an open position, a latching mechanism having a latching point and configured to open an isolating contact point disposed in a secondary current path parallel to a main current path, a main thermostatic bimetallic strip configured to act on the latching point to as to cause the main contact point to remain in the open position, a current limiting resistor disposed in the secondary current path, a selective thermostatic bimetallic strip disposed in the secondary current path and configured to act on the latching mechanism, a handle configured to act on the latching mechanism so as to open and close the main contact point, and a phase connecting rail.

24 Claims, 6 Drawing Sheets

U.S. PATENT DOCUMENTS

| | | | | | |
|---|---|---|---|---|---|
| 4,000,444 | A | * | 12/1976 | Douglas et al. | 361/45 |
| 4,056,816 | A | * | 11/1977 | Guim | 340/638 |
| 4,081,852 | A | * | 3/1978 | Coley et al. | 361/45 |
| 4,417,222 | A | * | 11/1983 | Schmitt et al. | 335/6 |
| 4,654,614 | A | * | 3/1987 | Chien et al. | 335/201 |
| 5,831,509 | A | * | 11/1998 | Elms et al. | 337/333 |
| 5,844,466 | A | * | 12/1998 | Fraisse | 337/379 |
| 5,859,578 | A | * | 1/1999 | Arnold | 337/110 |
| 5,894,259 | A | * | 4/1999 | Kolberg et al. | 337/333 |
| 6,160,470 | A | * | 12/2000 | O'Carroll et al. | 337/82 |
| 6,445,274 | B1 | * | 9/2002 | Malingowski et al. | 337/49 |
| 6,459,355 | B1 | * | 10/2002 | Furuhata et al. | 337/52 |
| 6,621,403 | B2 | * | 9/2003 | Nagahiro et al. | 337/75 |
| 7,518,482 | B2 | * | 4/2009 | Fleege | 337/59 |
| 2010/0127816 | A1 | | 5/2010 | Hofmann et al. | |
| 2010/0133074 | A1 | | 6/2010 | Eppe et al. | |

FOREIGN PATENT DOCUMENTS

| | | | | |
|---|---|---|---|---|
| DE | 19513062 | A1 | | 10/1996 |
| DE | 19526592 | A1 | | 1/1997 |
| DE | 102004019175 | A1 | | 11/2005 |
| DE | 102006051807 | B3 | | 3/2008 |
| DE | 102008018892 | A1 | | 10/2008 |
| DE | 102008021025 | A1 | | 10/2008 |
| DE | 102008017472 | A1 | | 11/2008 |
| EP | 43020 | A1 | * | 1/1982 |
| EP | 360215 | A2 | * | 3/1990 |
| EP | 1365432 | A1 | | 11/2003 |

* cited by examiner

INSTALLATION SWITCHGEAR

This is a U.S. National Phase Application under 35 U.S.C. §371 of International Application PCT/EP2008/003275, filed on Apr. 24, 2008, which claims priority to German Application No. DE 10 2007 020 114.3, filed on Apr. 28, 2007 and German Application No. DE 10 2008 017 472.6, filed on Apr. 3, 2008. The International Application was published in German on Nov. 6, 2008 as WO 2008/131900 under PCT Article 21 (2).

The invention relates to an installation switching device.

BACKGROUND

By way of example, installation switching devices of this generic type are disclosed in DE 195 26 592 C2 or DE 10 2004 019 175 A1. The main contact point is in this case normally in the form of a double contact point. Wound wire resistors, or else resistors in the form of a ceramic block, with which electrical contact is made by means of contact plates with pressure contact pieces, are known as current limiting resistors.

SUMMARY OF THE INVENTION

An aspect of the present invention is to further develop an installation switching device of this generic type so as to allow a more compact design with small external dimensions which in this case can be installed easily and complies with the requirements demanded by the relevant regulations.

Therefore, according to the invention, the secondary current path is connected in parallel with the series circuit formed by the first bimetallic strip and the main contact point, the main contact point is in the form of a single contact point with a fixed and a moving contact piece, and a phase connecting rail, which is connected to the input terminal, can be arranged close to the attachment face in the housing interior and running parallel to the attachment face, at the free end of which phase connecting rail a terminal contact is fitted, which projects out of the housing on the attachment face, for clamping on busbars in an installation distribution block. Parallel means approximately parallel as used herein.

The advantage of an installation switching device designed according to the invention is that the load on the main bimetallic strip is reduced, since, when the main contact opens, the current no longer flows via the main bimetallic strip, but bypasses the main bimetallic strip via the secondary current path. The main bimetallic strip is therefore loaded to a lesser extent thermally when the magnetic release operates, and it can therefore be designed to be smaller.

The main contact point, which is in the form of a single contact point according to the invention, is of mechanically simpler design than the known double contact points, and therefore requires less material to be used, results in a reduced power loss, is more compact, and therefore saves space for other components in the housing.

The advantageous effect of the phase connecting rail which can be fitted according to the invention is that the installation switching device according to the invention can thus be mechanically and electrically attached directly and without the interposition of an adapter, as well as without requiring any feed terminal, via the phase connecting rail, which is provided in the housing interior, to the phase rails of an installation distribution block.

An installation switching device which has the combination of features according to the invention therefore allows a more compact design with small external dimensions, and is simple to install.

In one advantageous embodiment of the invention, the phase connecting rail is connected to the input terminal via a flexible conductor piece. This simplifies the use of the phase connecting rail for manual or automatic manufacture of the device, since the phase connecting rail has a certain amount of freedom of movement.

The moving contact piece of the main contact point can advantageously be fitted to a main contact lever which is mounted on a fixed-position shaft such that it can pivot. This has the advantage that the switching accuracy and life of the device are increased, since the main contact lever can no longer be moved by force shocks acting on it during switching operations, because of being borne on a fixed-position shaft, and its position relative to the fixed contact piece therefore cannot change.

Furthermore, the main thermostatic bimetallic strip can advantageously be arranged parallel to the arc guide rail which is connected to the fixed contact piece of the main contact point. This allows a very compact internal arrangement of the individual components, as a result of which the overall design is highly space-saving.

According to one advantageous embodiment of the invention, the current limiting resistor is arranged in a first housing subarea, which is bounded by first partition walls, between the outgoer terminal and the arc quenching chamber. It is thus protected against influences of the arc and it can therefore be located closer to the arc quenching chamber, thus saving space in the housing. Furthermore, it can therefore be fitted in the vicinity of the output terminal, adjacent to the edge of the device, thus resulting in better heat dissipation from the current limiting resistance element. The current limiting resistor can therefore be made more compact overall.

In a further advantageous refinement, the current limiting resistor is in the form of a ceramic resistance block, is connected to the main thermostatic bimetallic strip by means of a busbar which makes contact with it in a sprung manner, and is connected to the selective bimetallic strip via an electrical conductor with high thermal conductivity. This leads to even better heat dissipation from the current limiting resistor, because of the thermal conduction via the solid conductor links and by convection with the world outside the device.

In a further advantageous embodiment, the current limiting resistor comprises an electrical wire winding with a winding input and a winding output, in which the winding wire is wound in a helical shape around a mount body which has two opposite end surfaces which are connected by a casing surface, and with at least one holding opening incorporated in one end surface of the mount body, in which holding opening one limb of a heat dissipation element can engage, for the purpose of heat dissipation from the wire winding. This allows the heat dissipation from the current limiting resistor to be improved further when using a wire-wound resistor, which is known in principle and is available at very low cost.

In a advantageous manner, the isolating contact point is in the form of a single contact point with a fixed and a moving contact piece, and is fitted on a plane which lies in the direction at right angles to the housing broad faces, behind the plane which is covered by the main bimetallic strip and the selective bimetallic strip. This feature according to the invention further enhances the compactness of the internal arrangement of the individual components in the installation switching device.

An advantageous further refinement is characterized in that the arc quenching chamber is arranged in a second housing subarea, which has second partition walls, between a first housing broad face and an imaginary plane which runs in the housing interior and is parallel to the first housing broad face, to which subarea a channel which passes outward is connected, via which any overpressure which occurs during a switching operation can be dissipated, and the switching gases which are created during the switching operation can escape to the outside.

In this case, the second housing subarea can advantageously be bounded toward the housing interior by a partition wall which runs parallel to the housing broad faces, such that a third housing subarea is created between this partition wall and the broad face opposite it.

The isolating contact point is advantageously connected to the third housing subarea, such that the ionized gases which are created when the isolating contact point opens can be dissipated into the third housing subarea.

An arrangement such as this has the advantageous effect that this ensures that the pressure that is created during the switching operation and the switching gases are dissipated outward from the main contact point, thus overall ensuring a highly space-saving and compact arrangement of the assemblies within the housing. In particular, venting is possible through the area of the isolating contact, which is created by the third housing subarea, that is to say the ionized gases which are created on opening of the isolating contact can be dissipated through the third housing subarea. They do not act on the contact pieces or the inner wall surfaces in the housing. This furthermore results in a higher withstand voltage, overall.

A further refinement option with an advantageous effect is characterized in that the arc quenching chamber of the main contact point has arc splitter plates which are aligned parallel to one another and to the housing broad face, and are arranged in at least two groups, with the distance between the splitter plates which bound the respective group and the respectively adjacent group or the respectively adjacent partition wall being greater than the distance between the splitter plates within one group. The sum of the distances between adjacent groups of splitter plate stacks and the distances between the splitter plate stacks which are adjacent to the partition walls and the partition walls themselves in this case advantageously corresponds at least to the specified minimum air gap. Two groups of splitter plates can be provided, each having the same number of splitter plates per group, or else three groups of splitter plates can be provided, each having the same number of splitter plates per group.

If, for example, the arc quenching chamber according to the invention is subdivided into three subareas, each subarea may for example have 6 splitter plates. The distance between the central subarea and the adjacent subareas may, for example, be 1.5 mm, and the distance between the outer subareas and the partition walls of the arc quenching chamber may also in each case be about 1.5 mm. The advantageous effect of the arrangement according to the invention is that the conditions which result from the relevant regulations relating to the minimum number of individual splitter plates, the minimum distance between plates in order that this distance counts as an air gap, and the required minimum air gap can also be complied with for a quenching chamber which, because of the compact housing dimensions, has a limited available area, for example only less than 30 mm, or only about 28 mm.

In a further advantageous embodiment, the fixed contact piece of the main contact point is electrically connected to the moving contact piece of the isolating contact point via a detachable plug connection. The plug connection may advantageously be in the form of a plug tulip, into which a plug is inserted. The advantageous effect is simplified assembly. In this case, the connection is first of all disconnected; the assembly comprising the latching mechanism and the isolating contact point is inserted first of all. The plug tulip according to the invention is fixed in the housing. The assembly comprising the main contact point is added in the next assembly step, and the connection conductor to the main contact is plugged into the plug tulip, by means of the plug.

Normally, a plug contact is admittedly disadvantageous because of the increased contact resistance, compared with a fixed connection, and is therefore not used, despite the simpler assembly, for installation switching devices of this generic type which are known from the prior art. However, in the installation switching device designed according to the invention, the higher contact resistance of a plug connection is no impediment since the current load on the plug connection occurs for only a very short time, because of the circuit layout according to the invention. When the current in the secondary circuit becomes excessive, the second bimetallic strip then interrupts the current flow, in conjunction with the latching mechanism, via the plug connection.

A further possible refinement of the invention is characterized in that the connection between the main thermostatic bimetallic strip and the moving contact piece of the main contact point can be made via two conductor elements, with a first conductor element connecting the main thermostatic bimetallic strip to the arc opposing guide rail which is opposite the fixed contact piece, and with a second conductor element connecting the arc opposing guide rail to the moving contact piece. The conductor elements are advantageously in the form of moving braids, as a result of which they allow freedom for movement of the moving contact piece. The advantageous effect of this embodiment is that this results in an additional blow-out loop, which forces the arc to be quenching when the contact point is opened. Furthermore, this decreases the commutation voltage drop which the arc must overcome when commutating from the moving contact to the opposing guide rail, as a result of which it is commutated more quickly onto the guide rail, thus speeding up the quenching of the arc.

A further advantageous refinement of the invention is characterized in that the connection between the main thermostatic bimetallic strip and the moving contact piece of the main contact point is formed by a flexible conductor or a flexible braid. This is attached at a point to the moving contact lever of the main contact point, for example by spot welding. A second moving conductor element runs from the attachment point of the first conductor element on the contact lever to the arc opposing guide rail which is opposite the fixed contact point. In one advantageous embodiment, the first and the second conductor elements are in this case subelements of a single braid, which are attached, for example by spot welding, to the main thermostatic bimetallic strip and to the arc guide rail, which is attached to the moving contact lever by means of an intermediate attachment point, for example likewise by spot welding. The advantageous effect of this embodiment is that the commutation voltage drop which the arc must overcome when commutating from the moving contact to the opposing guide rail is reduced, as a result of which the arc commutates more quickly onto the guide rail, thus speeding up the quenching of the arc.

One embodiment, which is also advantageous, is characterized in that the housing is approximately in the form of an inverted T and the longitudinal bar of the T is bounded by the front narrow faces and the front front face, with the latching mechanism, the isolating contact and the selective bimetallic strip being arranged in the housing part which is bounded by the front narrow faces and the front front face, while in contrast the main thermostatic bimetallic strip, the main contact point, the magnet system, the arc quenching device and the current limiting resistor are arranged in the housing part which is bounded by the rear narrow faces, the rear front face and the attachment face. An installation switching device having this combination of features according to the invention is highly compact and makes it possible to use a housing with 1.5 times the standard module width, that is to say with a width of 27 mm, in which all the assemblies and components of an installation switching device of this generic type can be accommodated, while, of course, complying with the standardized and specified air gaps and creepage distances, as well as switching gaps. It is also particularly advantageous to use a latching mechanism as described in DE 102006051807 since this can be designed to be sufficiently compact that it in any case fits into the housing part which is bounded by the front narrow faces and the front front face.

Further advantageous refinements and improvements of the invention, as well as further advantages, are specified in the further dependent claims.

BRIEF DESCRIPTION OF THE DRAWINGS

The invention as well as further advantageous refinements and improvements of the invention will be explained and described in more detail with reference to the drawings, which illustrate one exemplary embodiment of the invention, and in which.

DETAILED DESCRIPTION

Components or assemblies which are the same or have the same effect are annotated with the same reference numbers in the figures.

Figure 1:
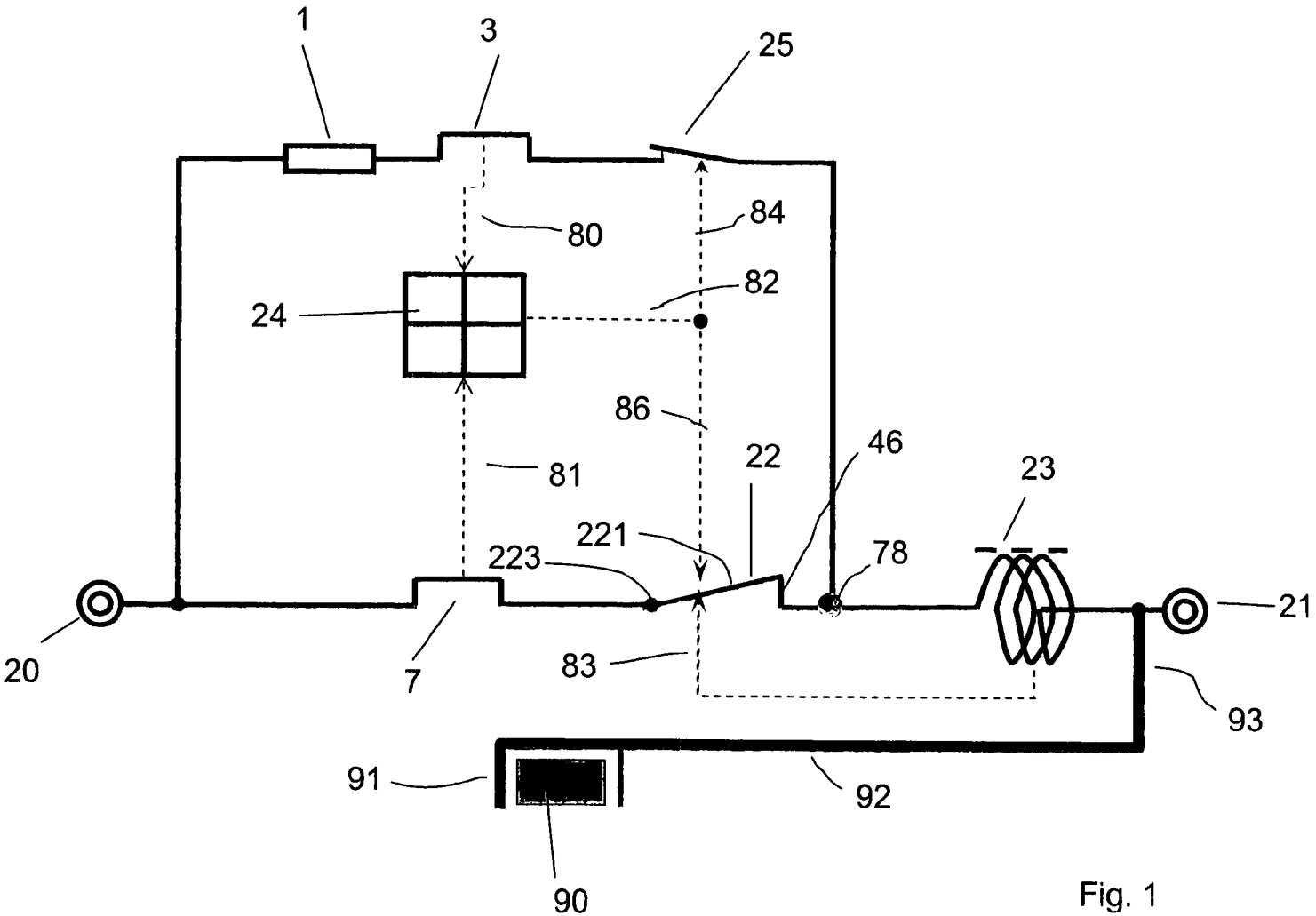
FIG. 1 shows a circuit layout of an installation switching device according to the invention.

FIG. 1 will be considered first of all. This shows the circuit layout of an installation switching device according to the invention. A main current path runs between an input terminal 21 and an output terminal 20, and also passes through a main thermostatic bimetallic strip 7, a main contact point 22 and an impact-type armature system 23. A secondary current path runs in parallel with the series circuit comprising the main current bimetallic strip 7 and the main contact point 22. This secondary current path comprises a current limiting resistor 1, a selective thermostatic bimetallic strip 3 and an isolating contact point 25.

The main contact point 22 is in the form of a single interruption and comprises a moving contact lever 221 which is fitted with the moving contact piece 44 (see FIG. 4), and a fixed contact point 222 with a fixed contact piece 46. The moving contact lever 221 is mounted on a shaft 223 which is fitted in a fixed position in the housing.

Furthermore, a mechanical latching mechanism 24 is included in the installation switching device. This is mechanically operatively connected on the one hand to the main thermostatic bimetallic strip 7 and to the selective thermostatic bimetallic strip 3 along lines of action 81, 80, and on the other hand the latching mechanism 24 is mechanically operatively connected to the isolating contact point 25 and the main contact point 22 along lines of action 82, 84, 86.

The installation switching device according to the invention and as shown in the circuit layout illustrated in FIG. 1 operates as follows. When a short-circuit current occurs in the main current path, the impact-type armature system 23 very quickly strikes the moving contact lever 221 away from the fixed contact piece 46 along the line of action 83 (see FIG. 4), and therefore opens the main current path at the main contact point 22. During this switching operation, a switching arc occurs at the main contact point 22 and is passed to an arc quenching arrangement, which is associated with the main contact point 22, see FIG. 5, where it is quenched.

When the main contact point 22 is opened, the current profile commutates onto the secondary current path. The short-circuit current now flows through the current limiting resistor 1, the selective thermostatic bimetallic strip 3 and the isolating contact point 25 to the connection point 78, where the main current path and the secondary current path are joined together. After a specific delay time, which can be predetermined inter alia by the choice of the resistance value of the current limiting resistor 1, the limited short-circuit current in the secondary current path causes the selective thermostatic bimetallic strip 3 to act along the line of action 80 on the latching mechanism 24 such that it permanently opens the isolating contact point 25 along the line of action 82, 84, and permanently opens the main contact point 22 along the line of action 86. An arc can likewise occur during this switching operation and is passed to a further arc quenching device, which is associated with the isolating contact point 25, where it is quenched. Both the main contact point and the isolating contact point have now been interrupted, and the current flow through the device has therefore been interrupted completely. Reconnection can now be carried out manually by operation of the latching mechanism 24 via a handle 26, see FIG. 2.

A busbar 92, also referred to as a phase connecting rail, is connected to the access terminal, also referred to as an input terminal, 21 via a flexible copper braid 93. This busbar 92 is fitted at its free end with a terminal contact 91, by means of which it can be clamped on a phase rail 90 in an installation distribution box when the installation switching device is fitted there. The installation switching device according to the invention can therefore be mechanically and electrically mounted, directly and without the interposition of an adapter and without requiring any feed terminal either, via the phase connecting rail 92 on the phase rails 90, which are also referred to as busbars, of an installation distribution block.

Figure 2:
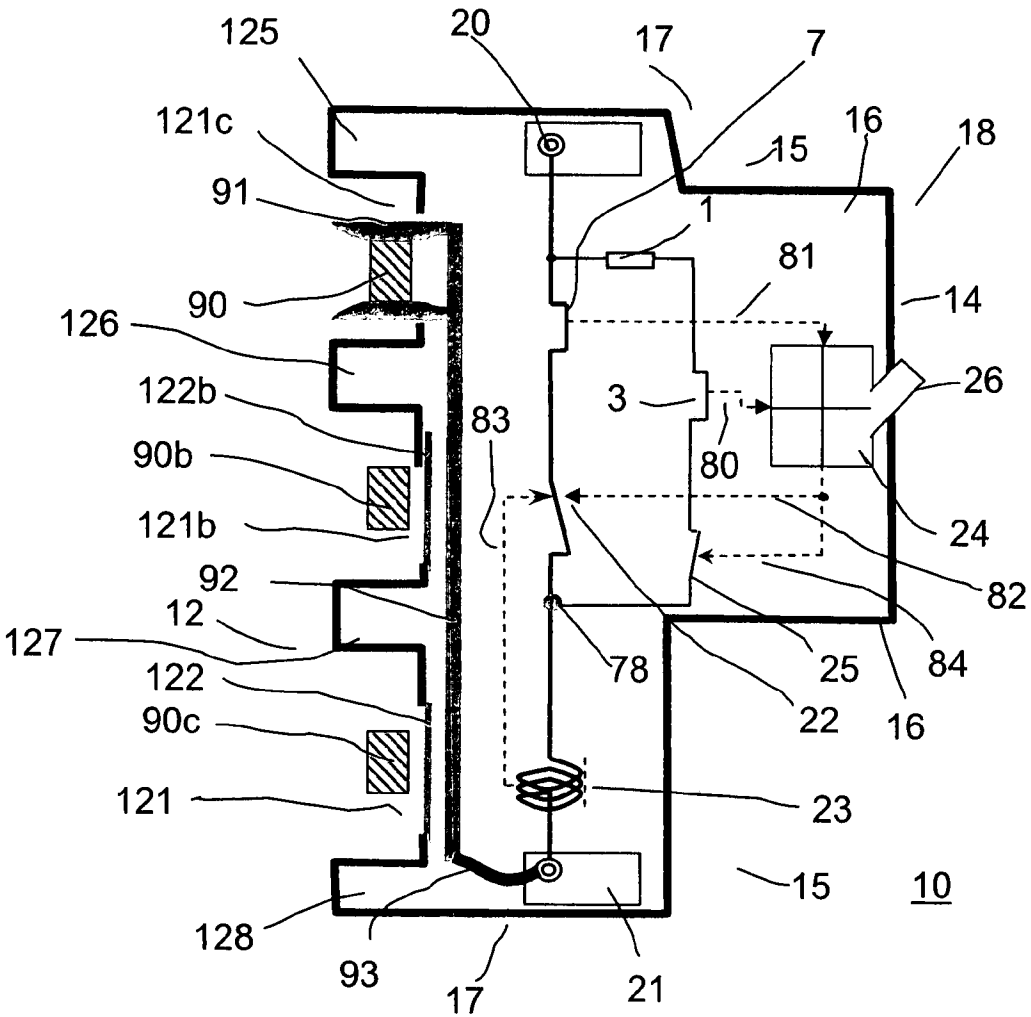
FIG. 2 shows, schematically, an installation switching device according to the invention, with the circuit layout being arranged in the interior of the housing.

FIG. 2 will now be considered. This shows the circuit layout as shown in FIG. 1, fitted into the circumferential contour of an installation switching device according to the invention. In this case, the individual elements of the circuit layout are shown within the housing contour and relative to one another in a position which corresponds approximately to that in the actual device.

The installation switching device 10 has an insulating material housing 18 which has a front front face 14, rear front faces 15, an attachment face 12, and front and rear narrow faces 16, 17. The front narrow faces 16 connect the front front face 14 to the rear front faces 15. The rear narrow faces 17 connect the rear front faces 15 to the attachment face 12. The housing 18 is approximately in the form of an inverted T, with the longitudinal bar of the T being bounded by the front narrow faces 16 and the front front face 14, and with the latching mechanism 24, the isolating contact 25 and the selective bimetallic strip 3 being arranged in the area of this longitudinal bar. The main thermostatic bimetallic strip 7, the main contact point 22, the impact-type armature system 23, the arc quenching device 200 (see FIG. 5) and the current limiting resistor 1 are arranged in the lateral bar of the T-shaped housing, which is bounded by the rear narrow faces, the rear front face and the attachment face.

Three phase connecting openings 121, 121*b*, 121*c* are incorporated on the attachment face 12 of the installation switching device. The phase connecting openings 121, 121*b*, 121*c* are positioned such that they correspond with the position of three busbars 90, 90*b*, 90*c* in an installation distribution block, when the installation switching device is fitted in the installation distribution block. The phase connecting rail 92 runs parallel to the attachment face 12 in the interior of the housing 18. The size and orientation of the position of the phase connecting opening 121*c* corresponds to the terminal contact 91 which is fitted to the free end of the phase connecting rail 92, as a result of which the terminal contact 91 passes through the phase connecting opening 121*c*, and can interact in a clamping manner with the busbar 90. The terminal contact 91 is in the form of a spring terminal contact with two mutually opposite sprung clamping strips. The two other phase connecting openings 121, 121*b* are covered by cover parts 122, 122*b*, as a result of which no dirt can enter the device interior at these points.

The device shown in FIG. 2 is therefore designed for connection to the outer ones of three busbars in an installation distribution block. When a device variant is required for connection to the central one of the three busbars, then the phase connecting rail 90 is replaced by another, shorter phase connecting rail, whose terminal contact projects out of the attachment face 12 in the installed state on the central phase connecting opening 122*b*. In this case, the two other phase connecting openings 121, 121*c* are then closed by appropriate cover plates. Projections 125, 126, 127, 128 are integrally formed on the attachment face 12 between the phase connecting openings. The housing can be mechanically supported by these projections 125, 126, 127, 128 on the other busbars, which are not electrically connected.

The installation switching device according to the invention therefore makes it possible to produce devices for connection to different busbars without any other change to the position of the internal functional components, simply by using a phase connecting rail of suitable length and opening the appropriate phase connecting opening, with the other phase connecting openings, which are not required, being closed by a cover plate. No further connecting means are required for connection of a device according to the invention to the busbars. This therefore results in a high degree of flexibility with a modular internal design of the device.

With a device according to the invention, it is, of course, also possible to connect an access conductor to the access terminal 21 in a known manner, for example by screwing it on by a screw terminal. This connection option may be used when the switching device according to the invention is installed at an installation location where there are no phase rails or busbars.

Finally, by means of the phase connecting rail 92 according to the invention, which is electrically connected to the access terminal 21 in the interior of the housing, a switching device according to the invention also opens up an application in which the current flow is supplied to the main current path via a conductor which is connected to the access terminal 21, and a busbar to which the device is attached is at the same time supplied with current via the phase connecting rail 92, in such a way that the installation switching device according to the invention also carries out the function of a phase connecting terminal to a busbar, in addition to its function as an automatic protective device.

When three installation switching devices according to the invention are arranged in a row with one another and are installed in an installation distribution block or a meter station with a three-phase busbar system, then each of the three devices is provided with one phase connecting rail, which is prepared for connection to a different busbar.

In summary, it can be stated that, because of the dual capability for electrical connection either via the access terminal 21 by means of a connecting conductor or via the phase connecting rail 92 by means of a busbar in an installation distribution block, an installation switching device according to the invention opens up a wide range of applications without having to carry out any changes in the device for different connection variants.

Figure 3:
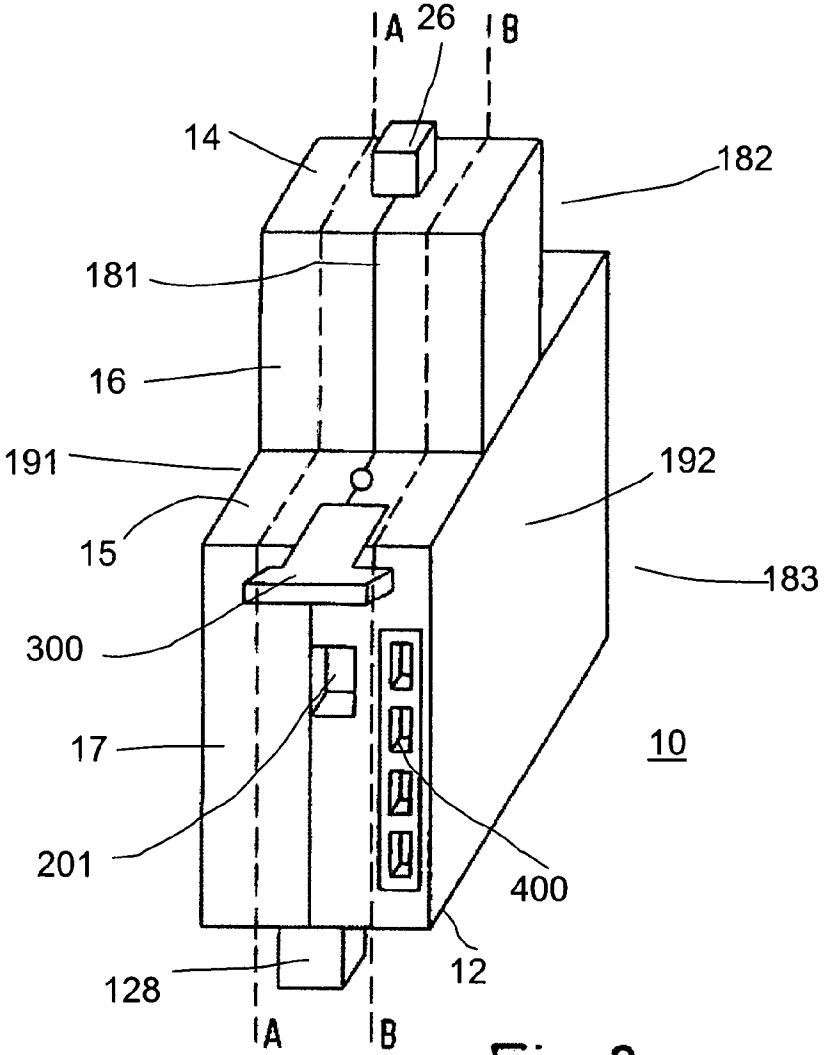
FIG. 3 shows a schematic external view of an installation switching device according to the invention.

FIG. 3 will now be considered. This schematically illustrates an oblique view of a narrow face of an installation switching device 10 according to the invention. The figure shows a right-hand broad face 192, a left-hand broad face 191, an opening 201 for the output terminal 20, an operating lever 300 for operation of the spring clamp 8 of the output terminal 20 (see FIG. 4) and vent openings 400 which are connected to the arc quenching chamber, which is associated with the main contact point, in the housing interior, see FIG. 5. This also has the advantage that the switching gases are dissipated toward the narrow face of the housing and therefore away from the attachment face and the busbar. The switching gases therefore cannot be precipitated on the busbars.

The housing 18 of the installation switching device 10 is formed from two half-shells which are joined together and connected to one another at a separating joint 181. The components and assemblies of the installation switching device 10 according to the invention are partially arranged one above the other in a direction at right angles to the broad faces 191, 192 in the interior of the housing 18, thus allowing the switching device 10 to have a very compact design. This compact internal design is explained in detail in the following FIGS. 4 and 5. The housing is approximately in the form of an inverted T, whose longitudinal web 182 is formed by the front narrow faces 16 and the front front face 14, and whose lateral web 183 is formed by the rear front face 15, the rear narrow faces 17 and the attachment face 12.

Figure 4:
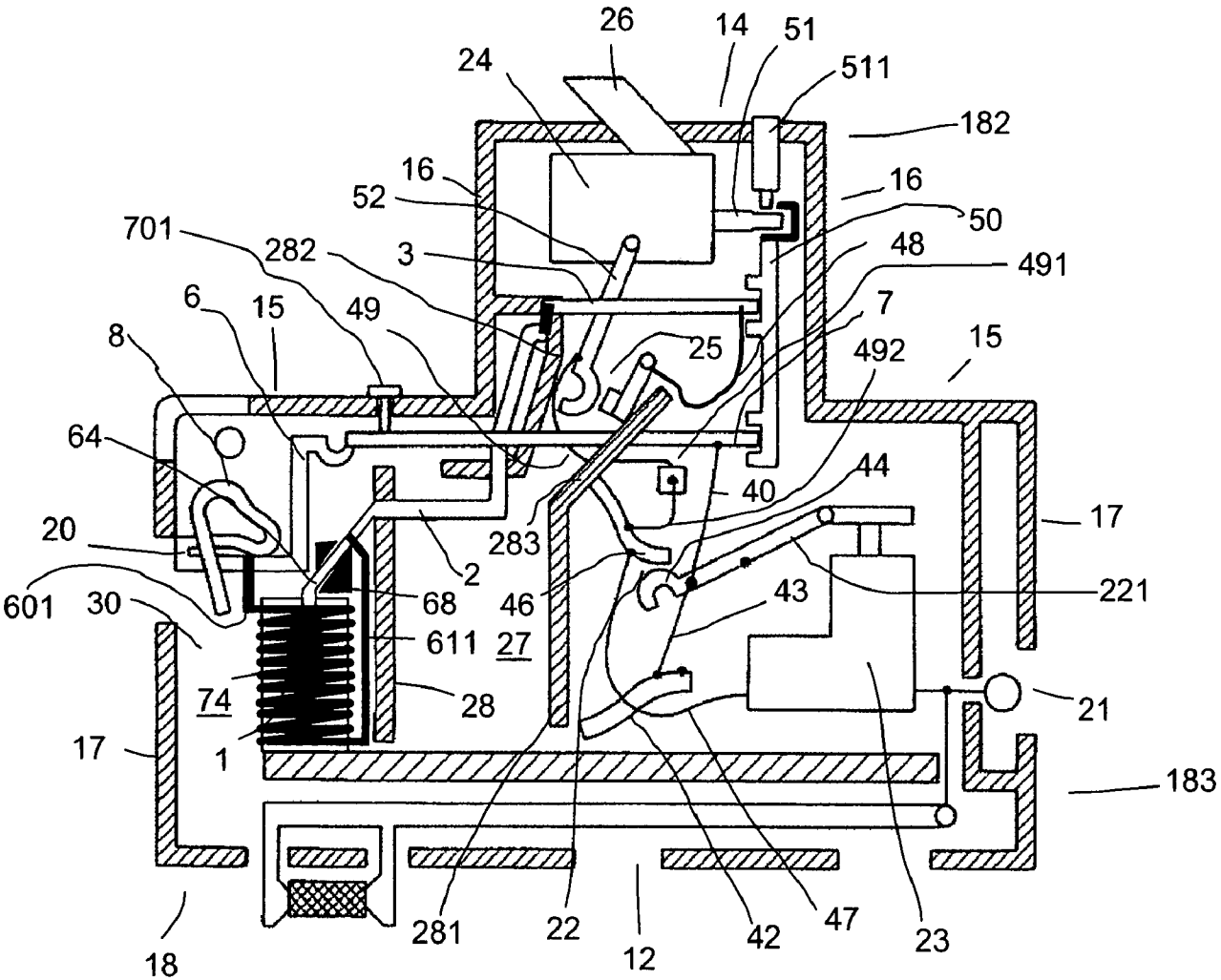
FIG. 4 shows, schematically, a view into an open installation switching device as shown in FIG. 3, along the section plane AA.

FIG. 4 will now be considered. This schematically illustrates a view into an open installation switching device as shown in FIG. 3, along the section plane AA, with the housing half-shell which forms the right-hand broad face 192 having been removed.

The output terminal 20 is in this case in the form of a spring force terminal with a compression spring 8. The operating lever 300, which is illustrated in FIG. 3, is not illustrated in FIG. 4, for the sake of clarity, but only in FIG. 5. It is mounted on a fixed-position shaft 301 in the housing and is used to operate the compression spring 8 when the intention is to insert a connecting conductor into the output terminal 20, or to remove such a conductor therefrom. The input terminal 21 is schematically illustrated as a circle, and may also be in the form of a spring force terminal, or else a screw terminal.

Starting from the terminal 20, the main current path runs via a busbar 6, which is referred to as the second busbar here, a main thermostatic bimetallic strip 7, which is fitted at the free end of the busbar 6, further from the free end of the main thermostatic bimetallic strip 7 via a braid 40 to the moving contact piece 44 of the main contact point 22, from the fixed contact piece 46 of the main contact point 22 via a busbar 47 to the impact-type armature system 23, and further to the terminal 21. The moving contact piece 44 is connected via a braid 43 to an arc guide rail 42.

The braids 40 and 43 are pieces of a single braid which is attached to the main thermostatic bimetallic strip 7 and to the arc guide rail 42. It is attached at a central point to the moving contact lever 221 in the vicinity of the moving contact piece, for example by spot welding.

Figure 5:
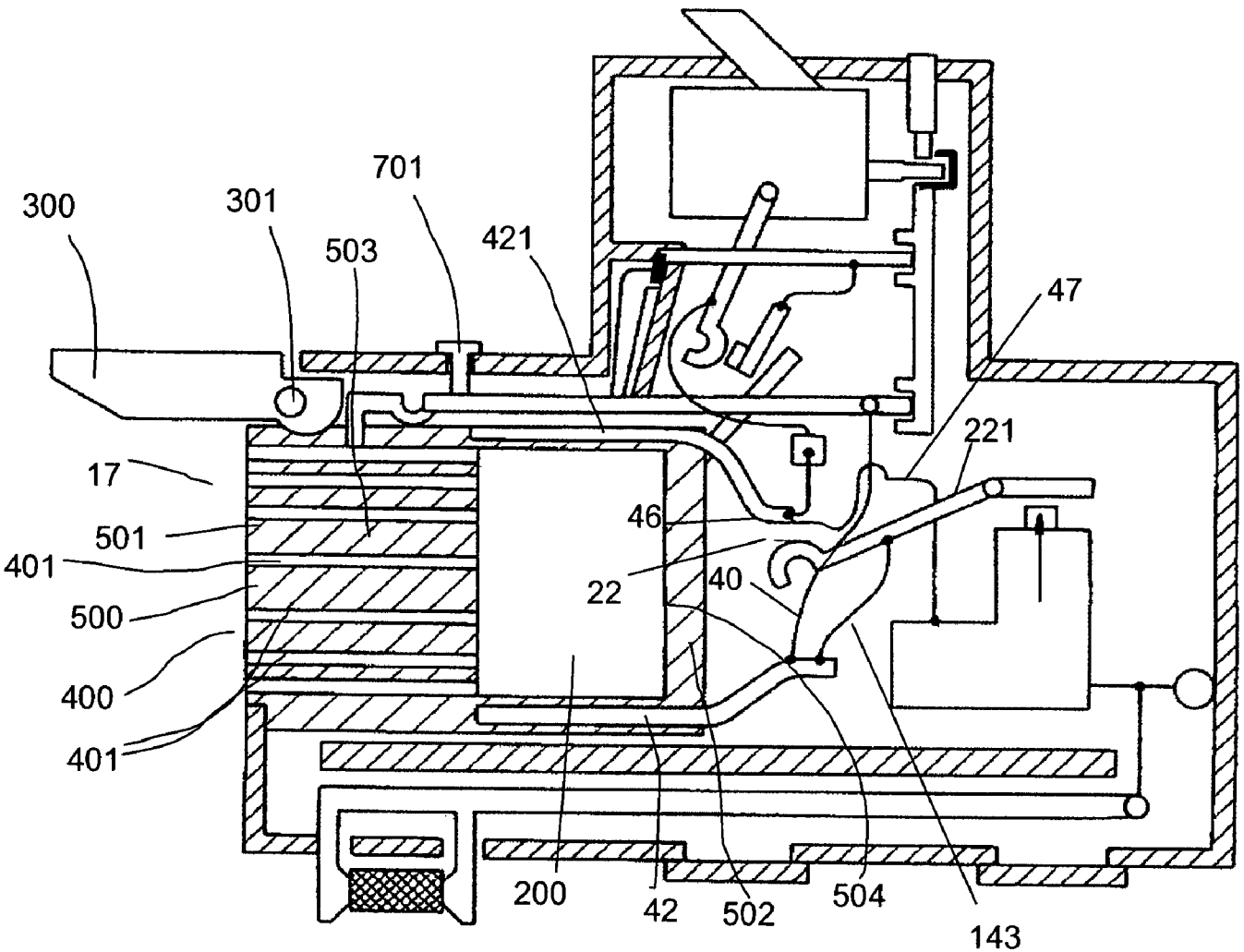
FIG. 5 shows, schematically, a view into an open installation switching device as shown in FIG. 4, along the section plane BB.

In a further embodiment, a braid can also be passed from the main thermostatic bimetallic strip 7 directly to the arc guide rail 42, without being attached to the moving contact lever 221. A further braid 143 is then provided, and connects the arc guide rail 42 to the moving contact lever 221. The braid routing of this variant is illustrated in FIG. 5.

The main thermostatic bimetallic strip 7 runs parallel to the rear front face 15 and can be calibrated by means of a calibration screw 701 from outside the device. The arc guide rail 42 is associated with the arc quenching device for the main contact point, and lies on a plane which is parallel to the left-hand broad face 191 and is between the left-hand and right-hand broad faces 191, 192 within the device. The arc quenching arrangement is therefore not illustrated in FIG. 4, and only a part of the arc guide rail 42 can be seen.

When the impact-type armature system 23 strikes the main contact point 22 as a result of a short-circuit current, and therefore interrupts the main current path, the current flow is commutated onto the secondary current path. Starting from the terminal 20, this runs via an access conductor 601 to the current limiting resistor 1, through the current limiting resistor 1 via an outgoer conductor 611 and a busbar, which is referred to as the first busbar 2, to the selective thermostatic bimetallic strip 3. The selective thermostatic bimetallic strip 3 is aligned parallel to the rear front face 15 and is accommodated in the longitudinal web 182. The secondary current path runs from the free end of the selective thermostatic bimetallic strip 3 further via a braid 48 to the fixed contact piece of the isolating contact point 25, then further from the moving contact piece of the isolating contact point 25 via a braid 49 to the fixed contact piece 46 of the main contact point 22, where the secondary current path meets the main current path.

The braid 49 leads to a plug contact 491 which comprises a plug tulip which is connected in a fixed position to the housing half-shell. A connecting braid 492 is fitted to the fixed contact piece 46 of the main contact point 22 and is fitted at its free end with a plug, which is intended for connection to the plug tulip of the plug contact 491. During assembly of the device, the connection is first of all disconnected at the plug contact 491. The assembly of the latching mechanism 24 and of the isolating contact point 25 is first of all used with the braid 49 and the plug tulip. The plug tulip according to the invention is fixed in the housing. In the next assembly step, the assembly of the main contact point 22 is used for this purpose with the braid 492, and the connection conductor 492 for the main contact is inserted by means of the plug into the plug tulip. This results in simple assembly and very good and accurate positioning of the individual assemblies within the housing.

In this case, the current limiting resistor 1 is formed by a heating wire winding 74, which is wound around a mount body with two opposite end surfaces, which are connected by a casing surface. The heating wire winding 74 comprises the winding input 601 and the winding output 611, as well as a turn part. The winding input 601 and the winding output 611 are extension pieces of the turn part, that is to say they are composed of the same wire. The heat dissipation element 64 is accommodated in a holding opening in the end face of the mount body and, at the same time, is a mount for the selective thermostatic bimetallic strip 3.

The free end of the heat dissipation element 64 is connected to the outgoer conductor 611. This results in a resistance assembly which can be prefabricated being formed.

Holding projections 68, for example in the form of integrally formed projections, are located on the inside of the housing half-shell, and leave a slot free between them. The heat dissipation element 64 is clamped firmly in this slot, as a result of which the resistance assembly is in this way positioned and held firmly in the housing in a simple manner. The heat dissipation element 64 considerably improves the heat dissipation from the current limiting resistor 1.

The free end of the selective thermostatic bimetallic strip 3 is coupled to a slide 50 which, once the selective thermostatic bimetallic strip 3 has been bent sufficiently in its thermal tripping direction, that is to say downward in the clockwise direction in the illustration shown in FIG. 4, operates the tripping lever 51 of the latching mechanism 24, in response to which the latching point in the latching mechanism 24 is unlatched, and the latching mechanism 24 opens the isolating contact point 25, via the secondary contact switching lever 52. In this case, the latching mechanism 24 also opens the main contact point 22 via a further lever mechanism, which is not shown here. The current flow through the device between the two connecting terminals 20, 21 is now interrupted completely. The latching mechanism 24 can also be operated manually, via a handle 26. The general method of operation described here for the switching device has already been described in patent application DE 10 2007 020 114, to which reference is expressly made in this context.

The tripping lever 51 can be fixed by means of a locking device 511 in its unlatched position, from outside the device, as a result of which it is then no longer possible to switch on from outside by means of the handle 26. The locking apparatus 511 can be designed as described in DE 102007018522.

Therefore, overall, the design according to the invention of the resistance assembly results in preferred and therefore directed heat transport from the current limiting resistor 1 into the first busbar 2, as far as the selective thermostatic bimetallic strip 3.

This is advantageous because the selective thermostatic bimetallic strip 3 is therefore very intensively coupled to the heat which is emitted from the current limiting resistor 1.

A subarea 27, referred to here as the third subarea, in the housing interior is separated by partition walls 28, 281, 282 and 283. The two partition walls 282 and 283 are integrally formed on the housing half-shell and form a type of funnel, whose broad opening is located in the area of the isolating contact point 25. When a switching arc occurs at the isolating contact point on opening of this isolating contact point, then gases which are created in this case are passed through this funnel into the third subarea 27. The two partition walls 28 and 281 are in this case part of an intermediate part 500, which is not illustrated for the sake of clarity, but which extends parallel to the housing broad face and closes the subarea 27 at the side and at the top, in the form of a cover. The switching gases from the isolating contact arc are thus carried into the third subarea 27 and cannot be precipitated in an uncontrolled manner on the contact points, thus preventing deterioration of the contact characteristics.

FIG. 5 will now be considered. This schematically shows a view into an open installation switching device as shown in FIG. 3, along the section plane BB, with the housing half-shell which forms the right-hand broad face 192 having been removed. This view shows the intermediate part 500 in its position in the left-hand housing half A pocket-like recess is formed in the right-hand half of the intermediate part 500, and this is also referred to as the second housing subarea 504, in which the arc quenching device 200 for the main contact point is accommodated. This essentially comprises an arc splitter plate stack, which will not been described any further in detail here. It is designed as described in DE 102007020115.

The arc is passed from the main contact point via a fixed contact guide rail 421 and an arc guide rail 42, which is referred to as an opposing guide rail, to the arc splitter plate stack. The main thermostatic bimetallic strip 7 and the selective thermostatic bimetallic strip 3 are located parallel to the fixed contact guide rail 421.

The right-hand part 502 of the upper face 501 of the intermediate part 500, on which the arc quenching device rests, forms the upper termination of the third subarea 27, which is illustrated in FIG. 4, into which the arc gases are introduced from the isolating contact.

The arc splitter plate stack is open on the left to the left-hand part 503 of the upper face 501 of the intermediate part 500, as a result of which the arc gases are passed out of the arc splitter plate stack into this subarea. The left-hand part 503 of the upper face 501 is fitted with webs 403 which are arranged parallel to one another and at right angles to the rear narrow face 17. These webs 403 form vent channels between them, which lead to the vent openings 400, which have already been illustrated in FIG. 3, in the rear narrow face 17 of the housing. The pressure which is created by the arc is dissipated through these vent channels, and the switching gases can escape outward through these vent channels. As already mentioned, this has the advantage that the switching gases are carried away toward the narrow face of the housing, and therefore away from the attachment face and the busbar.

A first housing subarea 30 is formed between the first partition wall 28, the rear narrow face 17 and the left-hand part 503 of the upper face of the intermediate part 500, and the current limiting resistor 1 is arranged in this housing subarea 30. The current limiting resistor 1 is therefore effectively shielded from the arc which occurs at the main contact point 22 when a switching operation takes place.

Figure 6:
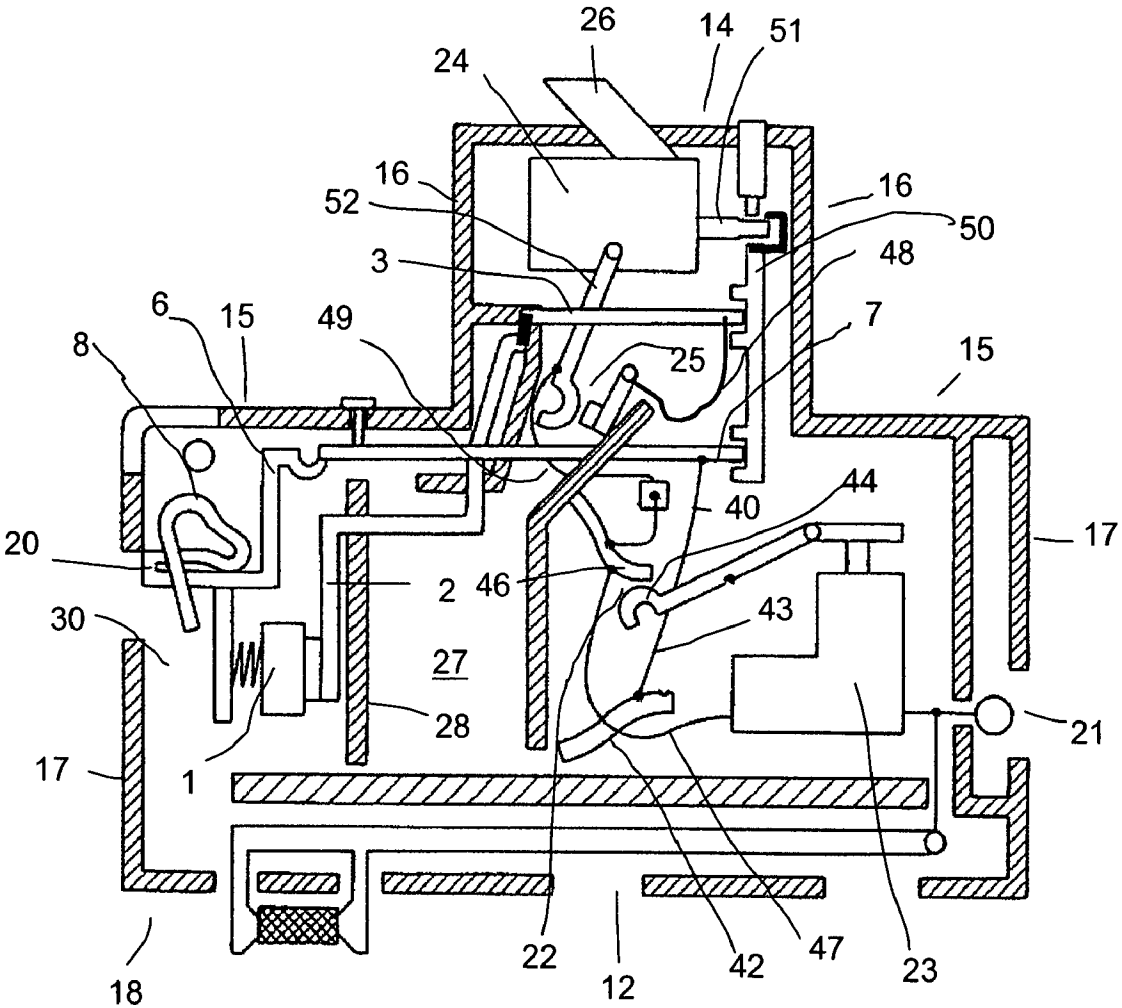
FIG. 6 shows, schematically, a view into an open installation switching device as shown in FIG. 3, along the section plane AA, in a further embodiment.

FIG. 6 shows a further embodiment of an installation switching device according to the invention. This differs from that illustrated in FIG. 4 in that the current limiting resistor 1 is in this case in the form of a cuboid ceramic block, composed of an electrically conductive ceramic. It is pressed by its flat broad face, opposite the access conductor 60, against the outgoer conductor 61 by a contact compression spring 5. The outgoer conductor 61 is in this case in the form of a robust busbar, and makes electrically conductive contact with the first busbar 2.

Important aspects of the present invention will be enumerated once more in the following text, but not in a final form.

The main current path comprises the main current bimetallic strip, the main contact point and the impact-type armature system.

The secondary current path comprises the selective resistor, the selective bimetallic strip and the isolating contact. The secondary current path is connected in parallel with the series circuit formed by the main current bimetallic strip and the main contact.

The main contact is in the form of a single interruption with a moving contact and a fixed contact. The moving contact is mounted on a shaft in a fixed position in the housing.

A phase connecting rail is connected directly to the access terminal in the interior of the housing via a flexible copper braid, and is fitted at its end with a connecting terminal for connection to a busbar.

The selective resistor is arranged between the outgoer terminal and the arc quenching chamber, to be precise in a separate housing area which is bounded by partition walls.

The main current bimetallic strip is arranged parallel to the arc guide rail of the fixed contact of the main contact.

The arc quenching chamber is arranged in a separate housing area, to which a channel which leads outward is connected, via which the pressure which occurs during short-circuit disconnections is dissipated.

The isolating contact is in the form of single interruption with a moving contact and a fixed contact, and is arranged isolated under the selective bimetallic strip and the main current bimetallic strip. The isolating contact is connected to a further housing area underneath the quenching chamber, into which the ionized gases which occur on contact opening are dissipated.

The impact-type armature system is arranged between the access terminal and the busbar connection, with one coil end being connected to the access terminal and the other end being connected via a busbar to the fixed contact of the main contact.

The latching mechanism, the isolating contact and the selective bimetallic strip are arranged in the upper housing part, while the current limiting resistor, the main current bimetallic strip, the main contact and the magnet system are arranged in the lower housing part.

The slide which makes the connection between the main bimetallic strip and the selective bimetallic strip and the tripping lever is arranged in the "upper" housing part, parallel to the front narrow face.

The main current bimetallic strip is attached to the outgoer terminal and can be adjusted via an adjusting device or calibration device which is attached to the housing.

The free end of the main current bimetallic strip is connected to the moving contact of the main contact and the opposing guide rail of the arc quenching chamber via a copper braid.

One end of the selective bimetallic strip is attached to a busbar which makes contact with the current limiting resistor, while the other (moving) end is connected via a flexible copper braid to the fixed contact of the isolating contact.

A busbar which leads to the busbar terminal is connected via a flexible copper braid directly to the access terminal.

The magnetic circuit in the interior is completely clad with insulation for reliable potential isolation between the access terminal, to be precise the busbar connection, and the moving contact of the main contact.

The impact-type armature system is arranged between the input terminal and the phase connecting rail, and a first coil end of the magnet coil of the impact-type armature system is connected to the input terminal, while the other end of the magnet coil is connected to the fixed contact piece of the main contact point.

The free ends of the main thermostatic bimetallic strip and of the selective bimetallic strip are connected by means of a slide, which acts on the tripping lever of the latching mechanism and is arranged in the vicinity of, and such that it can move longitudinally in a direction parallel to, a front narrow face in the housing part which is bounded by the front narrow faces and the front front face.

The main thermostatic bimetallic strip is connected to the output terminal, and can be adjusted via an adjusting device which is connected to the housing.

Openings for terminal contacts of the feed connecting conductors which are fitted in the housing interior to pass through it are provided on the attachment face of the housing, and their number and position correspond to the number and position of the busbars, as a result of which the openings correspond with the busbars when the installation switching device is in the installed state.

Openings through which no terminal contact passes are covered by means of detachable cover parts.

The phase connecting rail in conjunction with the access terminal results in a plurality of different usage and installation options for the device without having to carry out any changes to the device. These comprise:

feeding of the current via a connecting conductor to the access terminal, feeding of the current via a busbar, feeding of the current via the access terminal and passing it to a busbar for supplying voltage to further devices.

LIST OF REFERENCE SYMBOLS

| | |
|---|---|
| 1 | Current limiting resistor |
| 2 | First busbar |
| 3 | Selective thermostatic bimetallic strip |
| 5 | Contact compression spring |
| 6 | Second busbar |
| 7 | Main thermostatic bimetallic strip |
| 8 | Compression spring for the connecting terminal, spring terminal |
| 10 | Selective circuit breaker, installation switching device |
| 12 | Attachment face |
| 14 | Front front face |
| 15 | Rear front face |
| 16 | Front narrow face |
| 17 | Rear narrow face |
| 18 | Housing |
| 20 | Output terminal |
| 21 | Input terminal, access terminal |
| 22 | Main contact point |
| 23 | Impact-type armature system |
| 24 | Latching mechanism |
| 25 | Isolating contact point |
| 26 | Handle |
| 27 | Third subarea |
| 28 | First partition wall |
| 30 | First housing subarea |
| 40 | Braid |
| 42 | Arc guide rail |
| 43 | Braid |
| 44 | Moving contact piece |
| 46 | Fixed contact piece |
| 47 | Busbar |
| 48 | Braid |
| 49 | Braid |
| 50 | Slide |
| 51 | Tripping lever |
| 52 | Secondary contact switching lever |
| 60 | Access conductor |
| 61 | Outgoer conductor |
| 62 | Holding opening |
| 63 | Second holding opening |
| 64 | Heat dissipation element |
| 65 | Limb |
| 66 | Second limb |
| 67 | Inner sleeve surface |
| 68 | Holding apparatus |
| 70 | Mount body |
| 71 | Casing surface |
| 72 | End surface |
| 73 | End surface |
| 74 | Heating wire winding |
| 75 | Turn part |
| 76 | Cooling surface |
| 77 | Plug tulip |

-continued

| | |
|---|---|
| 78 | Connection point |
| 80 | Line of action |
| 81 | Line of action |
| 82 | Line of action |
| 83 | Line of action |
| 84 | Line of action |
| 86 | Line of action |
| 90 | Phase rail |
| 90b | Phase rail |
| 90c | Phase rail |
| 91 | Terminal contact |
| 92 | Busbar, phase connecting rail |
| 93 | Flexible braid |
| 121 | Phase connecting opening |
| 121b | Phase connecting opening |
| 121c | Phase connecting opening |
| 122 | Cover |
| 122b | Cover |
| 125 | Projection |
| 126 | Projection |
| 127 | Projection |
| 128 | Projection |
| 143 | Braid |
| 181 | Separating joint |
| 182 | Longitudinal web |
| 183 | Lateral web |
| 191 | Left-hand broad face |
| 192 | Right-hand broad face |
| 200 | Arc quenching device |
| 201 | Opening in the output terminal |
| 221 | Moving contact lever |
| 222 | Fixed contact point |
| 223 | Fixed-position shaft |
| 281 | Partition wall |
| 282 | Partition wall |
| 283 | Partition wall |
| 300 | Operating lever |
| 301 | Fixed-position shaft |
| 400 | Vent opening |
| 401 | Web |
| 431 | Fixed contact guide rail |
| 491 | Plug contact |
| 492 | Connecting braid |
| 500 | Intermediate part |
| 501 | Upper face of the intermediate part |
| 502 | Right-hand part of the upper face |
| 503 | Left-hand part of the upper face |
| 504 | Second housing subarea |
| 511 | Blocking device |
| 601 | Winding input |
| 611 | Winding output |
| 701 | Calibration screw |

The invention claimed is:

1. An installation switching device comprising:

a housing having an attachment face, a front front face, a rear front face, a first broad face, a second broad face, a front narrow face, and a rear narrow face, wherein the front and the rear narrow faces connect the attachment face and the front and rear front face;

a main contact point having an arc quenching chamber;

an input terminal;

an output terminal, wherein a main current path runs from the input terminal through the main contact point to the output terminal;

an impact-style armature system configured to move the main contact point to an open position, wherein the main contact point is in a form of a single contact point formed having a fixed and a moving contact piece;

a latching mechanism having a latching point and configured to open an isolating contact point disposed in a secondary current path parallel to the main current path;

a main thermostatic bimetallic strip configured to act on the latching point to as to cause the main contact point to remain in the open position;

a current limiting resistor disposed in the secondary current path;

a selective thermostatic bimetallic strip disposed in the secondary current path and configured to act on the latching mechanism;

a handle configured to act on the latching mechanism so as to open and close the main contact point; and a phase connecting rail disposed in an interior of the housing and close to and parallel to the attachment face and connectable to the input terminal, wherein a terminal contact is fitted at a free end of the phase connecting rail and projects out of the housing on the attachment face, the terminal contact configured to clamp on a busbar in an installation distribution block.

2. The installation switching device as recited in claim 1, further comprising a flexible conductor piece configured to connect the phase connecting rail to the input terminal.

3. The installation switching device as recited in claim 1, further comprising a main contact lever disposed on a fixed-position shaft so as to be pivotable, wherein the moving contact piece is fitted to the main contact lever.

4. The installation switching device as recited in claim 1, further comprising an arc guide rail connected to the moving contact piece and parallel to the main thermostatic bimetallic strip.

5. The installation switching device as recited in claim 1, wherein the current limiting resistor is disposed in a first housing subarea having first partition walls between the output terminal and the arc quenching chamber.

6. The installation switching device as recited in claim 1, wherein the current limiting resistor includes a ceramic resistance block and further comprising a first busbar connecting the ceramic resistance block to the main thermostatic bimetallic strip and contacting the current limiting resistor in a sprung manner; and further comprising an electrical conductor having a high thermal conductivity connecting the current limiting resistor to the second bimetallic strip.

7. The installation switching device as recited in claim 1, wherein the current limiting resistor includes an electrical wire winding with a winding input and a winding output, wherein a wire is wound in a helical shape around a mount body having two opposite end surfaces connected by a casing surface, and wherein at least one of the two opposite end surfaces defines at least one holding opening, wherein one limb of a heat dissipation element can engage in the at least one holding opening so as to dissipate heat from the wire winding.

8. The installation switching device as recited in claim 6, wherein the isolating contact point is a single isolating contact point formed between a fixed and a moving isolating contact piece, wherein the isolating contact point is disposed on a plane lying in a direction at a right angle to the first broad face and the second broad face, and behind a plane containing the main bimetallic strip and the selective bimetallic strip.

9. The installation switching device as recited in claim 1, wherein the arc quenching chamber is disposed in a second housing subarea between the first broad face and a plane disposed in a housing interior and parallel to the first broad face, wherein a channel passing outward is connected to the second housing subarea, and wherein any overpressure from a switching operation can be dissipated through the channel such that any switching gases can escape.

10. The installation switching device as recited in claim 9, wherein the second housing subarea is bound towards the housing interior by a partition wall running parallel to the first and the second broad faces, and wherein a third housing subarea is disposed between the partition wall and the second broad face.

11. The installation switching device as recited in claim 10, wherein the isolating contact point is connected to the third housing subarea, wherein ionized gases from an opening of the isolating contact point can be dissipated into the third housing subarea.

12. The installation switching device as recited in claim 1, wherein the impact-type armature system is disposed between the input terminal and the phase connecting rail, the impact-armature system having a magnet coil with a first coil end connected to the input terminal and a second coil end connected to the fixed contact piece of the main contact point.

13. The installation switching device as recited in claim 1, wherein the housing is approximately in a form of an inverted T, wherein a longitudinal bar of the T is bounded by the front narrow face and the front front face so as to form a first bounded part, wherein the latching mechanism, the isolating contact and the selective bimetallic strip are disposed in the first bounded part, and wherein the main thermostatic bimetallic strip, the main contact point, a magnet system, the arc quenching device, and the current limiting resistor are disposed in a second bounded part bounded by the rear narrow face, the rear front face and the attachment face.

14. The installation switchgear as recited in claim 13, wherein a free end of the main thermostatic bimetallic strip and a free end of the selective bimetallic strip are connected by means of a slide acting on a tripping lever of the latching mechanism, wherein the slide is disposed in an area of the front narrow face so as to move longitudinally in a direction parallel to the front narrow face in the first bounded part.

15. The installation switching device as recited in claim 1, further comprising an adjusting device connected to the housing and configured to adjust the main thermostatic bimetallic strip connected to the output terminal.

16. The installation switching device as recited in claim 4, further comprising a first conductor element connecting the main thermostatic bimetallic strip and the moving contact piece of the main contact point so as to form a connection; and further comprising a second conductor element connecting the arc guide rail and the moving contact piece.

17. The installation switching device as recited in claim 8, further comprising a moving conductor piece configured to connect a free end of the selective thermostatic bimetallic strip to the fixed isolating contact piece, wherein the first busbar is attached to a fixed end of the selective thermostatic bimetallic strip.

18. The installation switching device as recited in claim 8, further comprising a detachable plug connection configured to electrically connect the fixed contact piece to the moving isolating contact piece.

19. The installation switching device as recited in claim 1, further comprising a plurality of feed connecting conductors fitted in the housing interior and each one having a terminal contact passing through one of a plurality of openings disposed in the attachment face, wherein each one of the plurality of feed connecting conductors and the plurality of openings corresponds to a busbar when the installation device is in an installed state.

20. The installation switching device as recited in claim 19, wherein each of the plurality of openings through which the terminal contact does not pass are covered by a detachable cover part.

21. The installation switching device as recited in claim 1, wherein the arc quenching chamber includes a plurality of arc splitter plates aligned parallel to one another and the first broad face and arranged in at least two groups, wherein a distance between one of the at least two groups and an adjacent group of the at least two groups or an adjacent partition wall is greater than a distance between two of the plurality of arc splitter plates within one of the at least two groups.

22. The installation switching device as recited in claim 21, wherein a sum of the distance between adjacent groups of the at least two groups and the distance between one of the at least two groups and the adjacent partition wall corresponds to a specified minimum air gap.

23. The installation switching device as recited in claim 22, wherein the arc quenching chamber includes two groups of arc splitter plates, each group having an equal number of splitter plates.

24. The installation switching device as recited in claim 23, wherein the arc quenching chamber includes a third group of arc splitter plates, each group having an equal number of splitter plates.

* * * * *